US005813320A

United States Patent [19]

Frasnetti et al.

[11] Patent Number: 5,813,320

[45] Date of Patent: Sep. 29, 1998

[54] GAS APPLIANCE FOR HEATING AND/OR COOKING FOOD AND THE LIKE

[75] Inventors: Luca Frasnetti, Cunardo; Gianpiero Santacatterina, Sangiano; Alessandro Distaso, Gemonio, all of Italy

[73] Assignee: Whirlpool Corporation, Benton Harbor, Mich.

[21] Appl. No.: 843,199

[22] Filed: Apr. 14, 1997

[30] Foreign Application Priority Data

Apr. 15, 1996 [IT] Italy ..... MI96A0721

[51] Int. Cl.[6] ..... A21B 1/00; A23L 3/00; F24C 3/00; A47J 27/26

[52] U.S. Cl. ..... 99/333; 99/325; 99/403; 99/452; 126/39 G; 126/41 R; 236/20 A

[58] Field of Search ..... 99/331–333, 326–330, 99/344, 403, 452; 126/20, 21 R, 39 D–39 G, 41 R, 42, 391, 85 R, 512; 219/452, 506; 236/20 A, 1 A; 340/603; 431/6, 80

[56] References Cited

U.S. PATENT DOCUMENTS

| | | | |
|---|---|---|---|
| 3,851,640 | 12/1974 | Keating et al. | 126/391 |
| 4,070,670 | 1/1978 | Chen | 99/344 X |
| 4,671,250 | 6/1987 | Hurley et al. | 126/39 R |
| 4,724,823 | 2/1988 | Simpson | 126/39 H |
| 4,913,038 | 4/1990 | Burkett et al. | 99/332 X |
| 4,993,401 | 2/1991 | Diekmann et al. . | |
| 5,310,110 | 5/1994 | Akamatsu et al. | 99/344 |
| 5,575,638 | 11/1996 | Witham et al. . | |
| 5,628,242 | 5/1997 | Higley | 99/332 |

FOREIGN PATENT DOCUMENTS

| | | | |
|---|---|---|---|
| 0 550 340 | 7/1993 | European Pat. Off. | G05D 7/06 |
| 2 673 703 | 11/1992 | France | F23N 5/24 |

*Primary Examiner*—Timothy F. Simone
*Attorney, Agent, or Firm*—Thomas A. Schwyn; Stephen D. Krefman; Robert O. Rice

[57] ABSTRACT

Solenoid valves for controlling the gas flow to burners are controlled by an electronic microprocessor card by means of pulse-width modulated signals. The electronic card can receive signals from a timer to be set by the user, and from means by which the user selects the heat output of the burners. The first of said means to be operated by the user after setting the time makes the relative burner dependent on the timer. When the two data (time and heat output) have been set, the card extinguishes the flame of the dependent burner when the set time has expired.

8 Claims, 3 Drawing Sheets

GAS APPLIANCE FOR HEATING AND/OR COOKING FOOD AND THE LIKE

BACKGROUND OF THE INVENTION

1. Field of the Invention

This invention relates to a gas appliance for heating and/or cooking food and the like. The appliance is of the type summarized in the introduction to the accompanying claim 1.

2. Description of the Related Art

Appliances for heating and/or cooking food and the like are known provided with one or more burners which can be selected and regulated by the user, for example by means of knobs. Solenoid valves are also known, for example from EP-A-055034, for controlling the gas flow to the burners on the basis of variable-duration pulse signals fed to them. It is further known to use timers for setting the food cooking or heating times. It is likewise known to use temperature probes to be inserted into the food to monitor its temperature.

In the case of appliances provided with several burners it is known either to associate a separate timer with each burner or to provide one timer common to all burners, which is associated with the particular selected burner by a selector button.

This known arrangement comprising a common timer hence requires a timer, a selector button and a number of gas regulator knobs or the like equal to the number of burners.

SUMMARY OF THE INVENTION

Using the selector button involves forming a hole in the appliance to install it, and provision of the button, cabling and mechanical fixing devices, with consequent costs the elimination of which represents one of the objects of the present invention.

It is often necessary to control cooking or heating such that the food does not exceed a certain temperature, for example in the heating of pasteurized milk or other liquid or pasty foods which would other wise require heating by a water bath. This problem is also solved economically by the present invention.

These and further objects which will be more apparent from the detailed description given hereinafter are attained according to the present invention by using the teachings of the accompanying claims.

BRIEF DESCRIPTION OF THE DRAWINGS

The invention will be more apparent from the detailed description of preferred embodiments thereof given hereinafter by way of non-limiting example with reference to the accompanying drawing, in which.

DESCRIPTION OF THE PREFERRED EMBODIMENT

Figure 1:
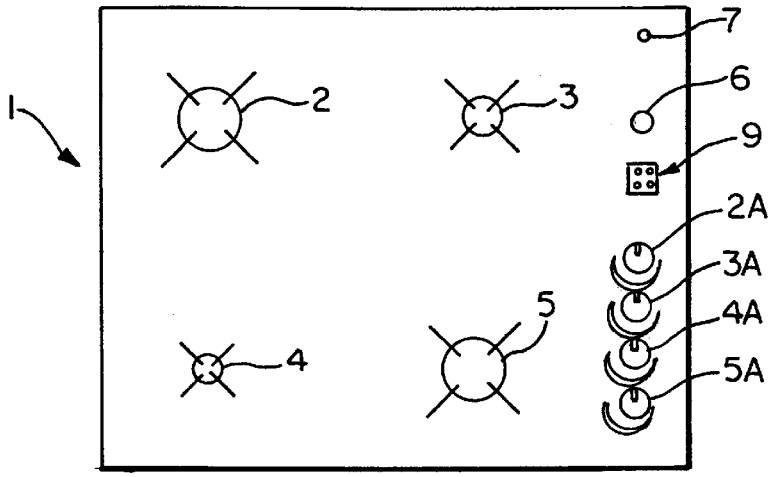
FIG. 1 is a schematic view from above showing a four-burner cooking hob.

The illustrated cooking hob 1 comprises four burners 2, 3, 4, 5, preferably of different heat output. To each of these there is assigned on the cooking hob one of the four knobs 2A, 3A, 4A, 5A, which have the double purpose described hereinafter. The cooking hob also comprises a knob 6 for setting a timer, a socket 7 for connecting a temperature probe 8, and four LEDs 9.

The gas flow to each burner 2–5 is controlled by a solenoid valve 10 (one per burner) controlled by signals obtained in known manner by pulse width modulation of a continuous signal. For this purpose the solenoid valves 10 are connected to a microprocessor card 11. To this latter there are also connected the four LEDs (one for each knob 2A–5A), the timer 6 and the knobs 2A–5A. The timer, of which only the knob is shown, can be of electromechanical, potentiometric and/or digital type. In the case of the digital type, a digital display unit is provided, in the usual manner. The double-purpose knobs 2A–5A can be of electromechanical, potentiometric and/or digital type. If the potentiometric type is used, analog/digital conversion means are provided to dialogue with the microprocessor card 11.

Figure 4:
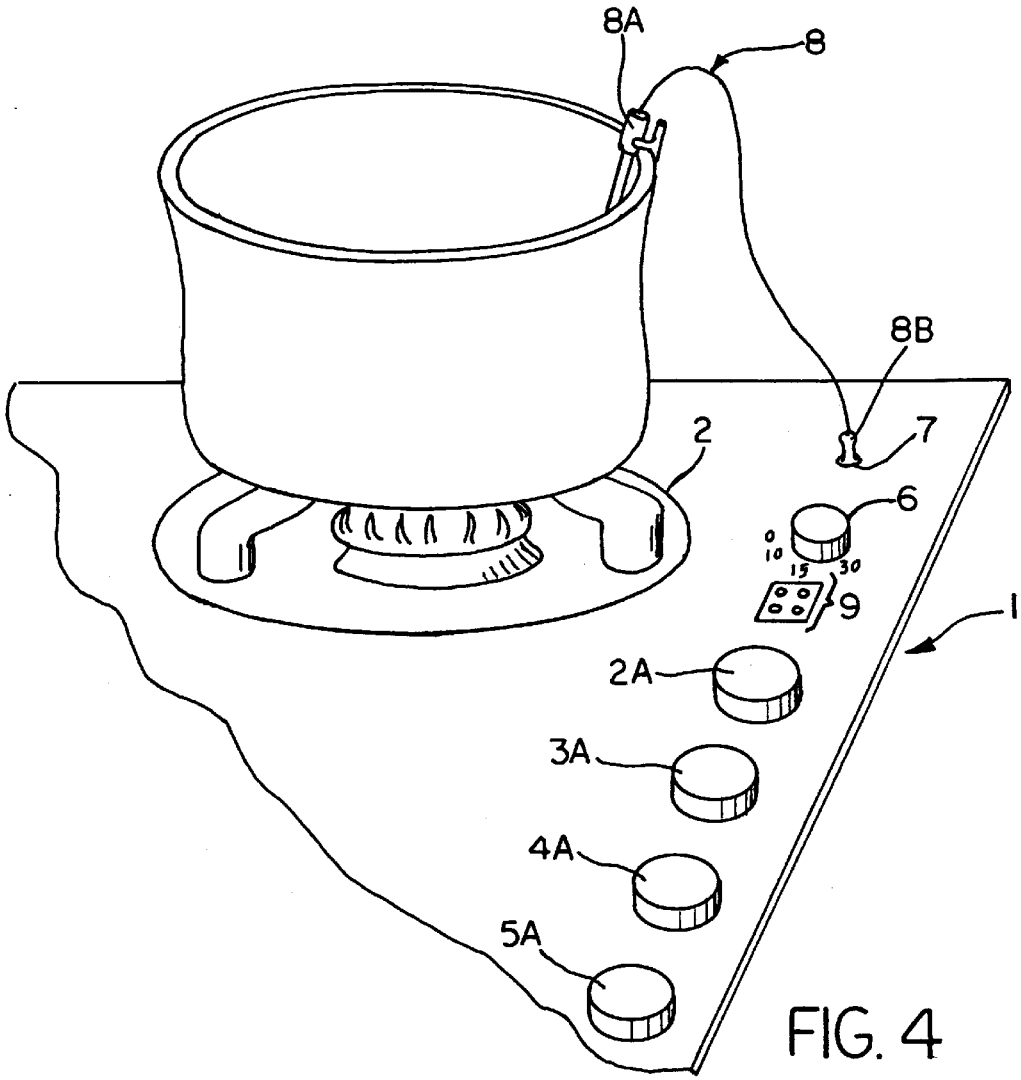
FIG. 4 is a perspective schematic view showing the use of a temperature sensor on the cooking hob.
Figure 5:
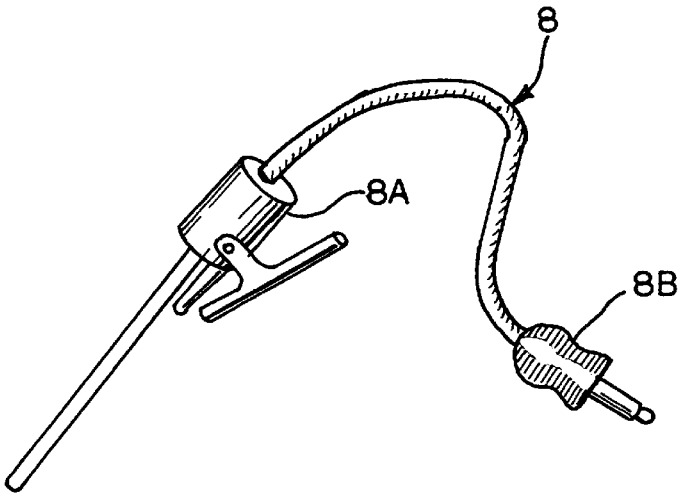
FIG. 5 is a perspective view of a temperature sensor.

The temperature sensor or probe 8 of conventional immersion or insertion type comprises a thermoinsulating elastic clamp 8A (by which it can be supported on the edge of a saucepan, as shown in FIG. 4) and a plug 8B for removable coupling to the socket 7. The temperature sensor 8 is associated with or incorporates analog/digital conversion means.

The operation and the prior programming are as follows.

Figure 2:
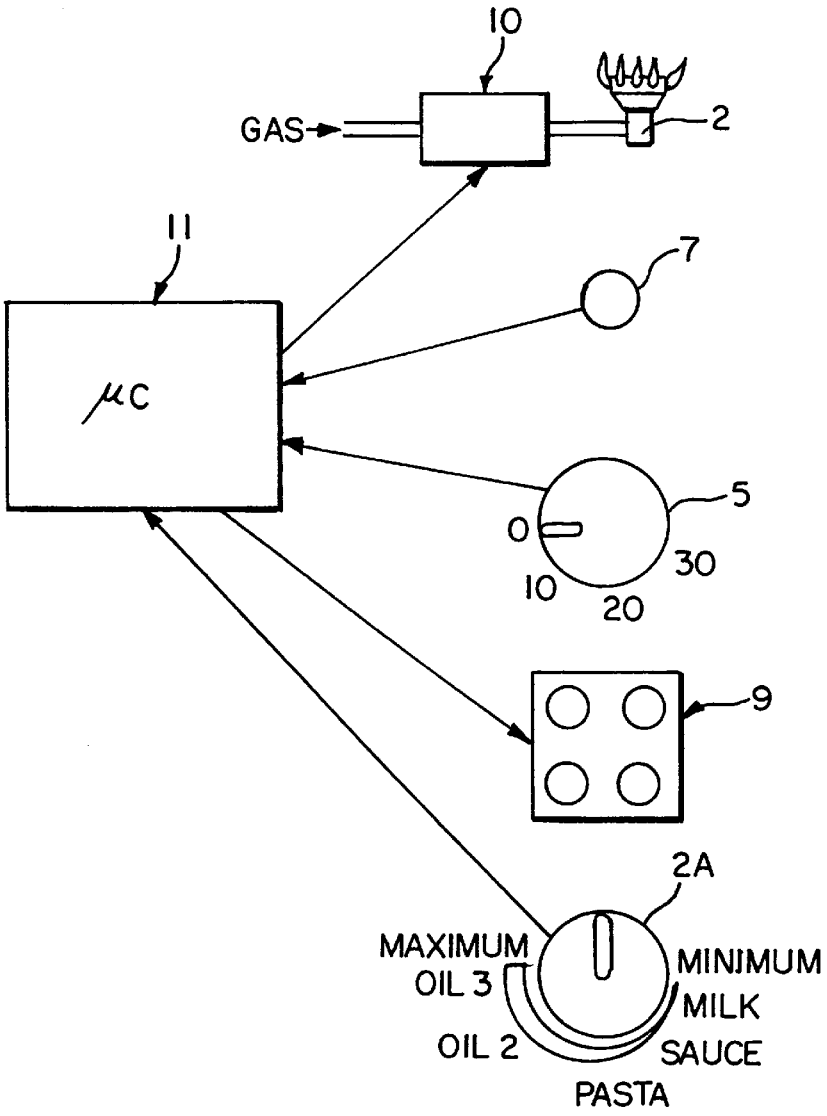
FIG. 2 is a schematic view of the circuit arrangement, limited to a single burner.
Figure 3:
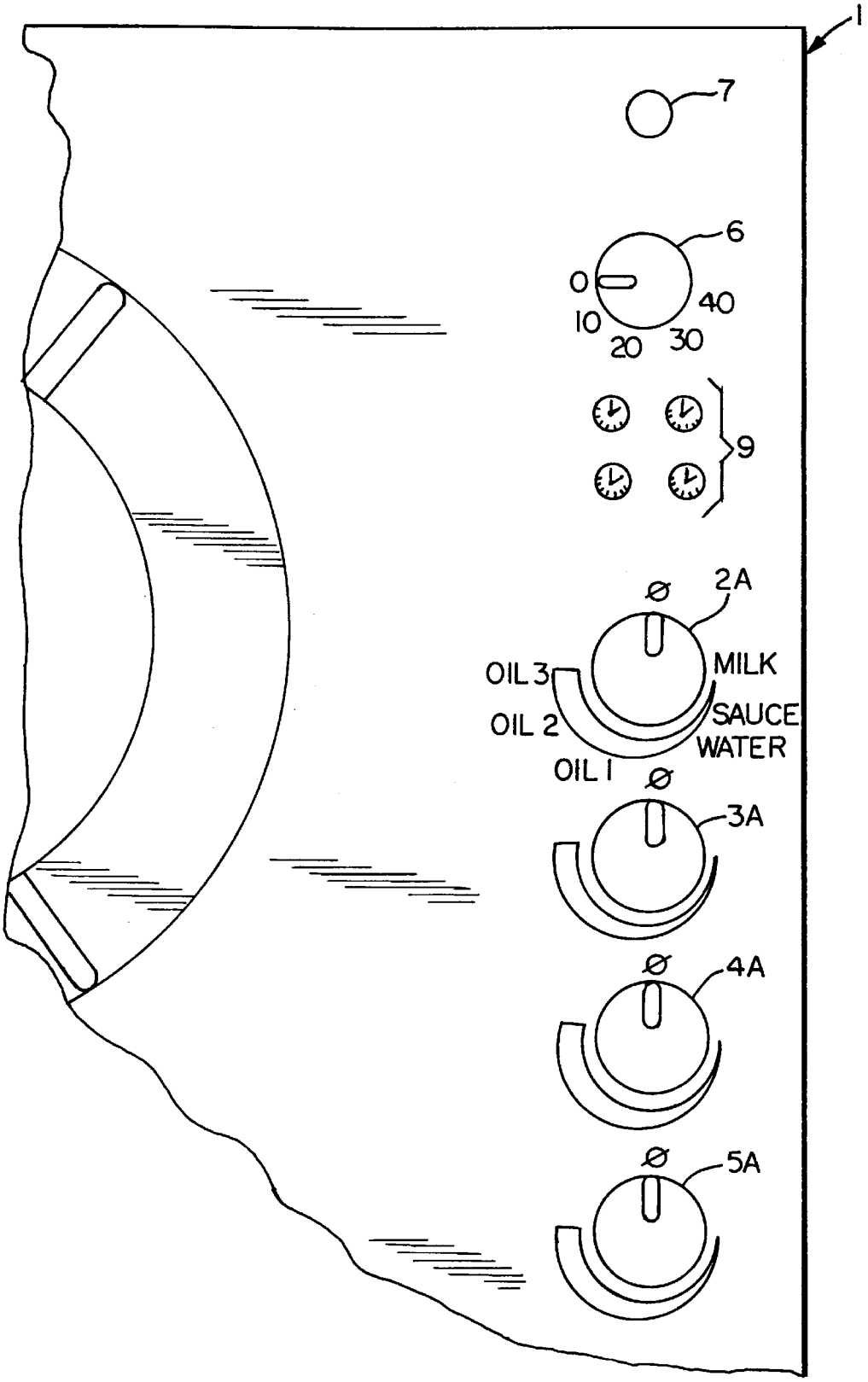
FIG. 3 shows a detail of the cooking hob, this detail concerning the user interface.

It will be assumed that the temperature sensor 8 is not connected to the relative socket and that the user wishes to cook or heat a food for a given time at a given calorific power (this latter can be indicated alphanumerically on a scale, such as that shown in FIG. 2). On this basis the user sets the desired time (also indicated on an associated scale) by the timer 6. The four LEDs 9 light to indicate that the card 11 has been notified of the action on the timer 6. If within a predetermined number of seconds "n" (for example 5–10 seconds) any one of the knobs 2A–5A is operated to set the desired heat output of the relative burner, the card 11 leaves only that of the LEDs 9 lit which corresponds to the specific knob 2A–5A operated, the valve 10 of this burner now being dependent on the set time. On termination of the time set on the timer 6, the particular burner 2–5 concerned is automatically extinguished by securely closing the valve 10. The lit LED 9 now flashes, with the possible emission of an audio signal (by another device, not shown) to inform the user that the process has ended. If within the said time "n" no knob 2A–5A is operated, the four LEDs 9 are extinguished and the timer 6 assumes the function of a simple time counter by acoustically indicating the time which has passed, but without extinguishing any burner. The described embodiment results in a cost reduction deriving from the absence of the usual pushbutton for selecting the burner to be placed under the control of the timer 6 and of the members connected to said pushbutton, because the information regarding which burner is to be placed under the control of the timer 6 is derived from the movement of that knob 2A–5A which the user initially moves after setting the timer 6.

It can be seen from the description that a function of the knobs 2A–5A is to provide the card 11 with information enabling the card to control the solenoid valve 10 and hence the heat output of the selected burner.

When the temperature sensor 8 is utilized, this being applied and used as shown in FIG. 4, a selected knob 2A–5A performs its second function, which is to set the desired cooking or heating temperature.

In practice, when the user connects the temperature sensor 8 to the socket 7, a waiting signal reaches the card 11. If none of the burners 2–5 is in operation, the card changes the function of all the knobs 2A–5A in the sense that these can be temporarily used to set the required temperature.

When the user acts on the knob 2A–5A corresponding to that burner 2–5 on which the saucepan carrying the temperature sensor 8 (FIG. 4) is positioned, only that knob of the knobs 2A–5A retains the facility for setting the required temperature, whereas the others return to their primary function (ie to regulate the heat output of the relative burner).

In this situation the card 11 compares the set temperature with that measured by the temperature sensor 8 and based on the resultant difference the card 11 regulates the flame of the burner concerned so that the food attains and maintains the set temperature.

If the burner flame should become extinguished (which could happen when the set temperature is reached), conventional safety devices warn the card 11, which closes the valve 10 concerned, to reopen it and ignite the flame by other known spark devices when the measured temperature gives rise to a difference signal.

If however other burners are in operation, the card 11 sets the knobs 2A–5A not associated with those burners to their second function, to then maintain set to the second function only that knob which is activated and which corresponds to the burner on which the saucepan fitted with the temperature sensor is positioned.

To avoid errors, for example operating a knob different from the correct one, further visual warning means are provided to indicate, for example by flashing, which of the knobs has been operated.

In a simpler modification, only one of the knobs can change its function or is uniquely associated with the temperature sensor. In other words, on connecting the sensor only one specific knob becomes a temperature regulator.

In a second modification, with each knob there is associated a socket for the temperature sensor so that when this latter is connected to a specific socket among the various sockets provided, a likewise specific knob becomes a temperature regulator.

The two described functions can be combined by the user. For example by using the probe and timer, the user can set the required temperature to be maintained for a given time for the food or the like contained in a saucepan positioned on a given burner.

If the temperature sensor is not connected and the timer 6 is not set, the appliance operates in the conventional manner, as it also does for the three remaining burners when the fourth is under the control of the timer.

We claim:

1. A gas appliance for heating and/or cooking food by burners fed via solenoid valves controlled by signals derived from pulse-width modulation of another signal, the appliance comprising timer means operated by the user to set the cooking or heating time, a plurality of knobs, also operated by the user, to set the heat output of the burners, and control means for providing the solenoid valves with said signals on the basis of the set cooking or heating time and the set heat output, wherein after setting the cooking or heating time and within a certain time period from said setting, the first of said plurality of means operated by the user for setting the heat output makes the operation of the relative burner dependent on the set time.

2. An appliance as claimed in claim 1, wherein visual indicator means are provided to indicate which of the burners is dependent on the set time.

3. An appliance as claimed in claim 2, to which a temperature sensor can be connected, which once connected causes the function of a selected one of the means to be switched from setting the heat output to setting a reference temperature with which to compare the temperature measured by the temperature sensor, in order to control the selected burner.

4. An appliance as claimed in claim 3, wherein a socket for the temperature sensor is associated with each burner.

5. An appliance as claimed in claim 4, wherein the socket for the temperature sensor is associated with only one burner with knob.

6. An appliance as claimed in claim 1, to which a temperature sensor can be connected, which once connected causes the function of a selected one of the means to be switched from setting the heat output to setting a reference temperature with which to compare the temperature measured by the temperature sensor, in order to control the selected burner.

7. An appliance as claimed in claim 1, wherein a socket for the temperature sensor is associated with each burner.

8. An appliance as claimed in claim 1, wherein the socket for the temperature sensor is associated with only one burner with knob.

* * * * *